US012595620B2

(12) United States Patent
Croft

(10) Patent No.: US 12,595,620 B2
(45) Date of Patent: Apr. 7, 2026

(54) SYSTEM FOR INDEXING AND ORIENTING GARMENTS

(71) Applicant: Ryan Douglas Croft, Pisgah Forest, NC (US)

(72) Inventor: Ryan Douglas Croft, Pisgah Forest, NC (US)

( * ) Notice: Subject to any disclaimer, the term of this patent is extended or adjusted under 35 U.S.C. 154(b) by 0 days.

(21) Appl. No.: 18/318,951

(22) Filed: May 17, 2023

(65) Prior Publication Data

US 2023/0374722 A1 Nov. 23, 2023

Related U.S. Application Data

(60) Provisional application No. 63/364,819, filed on May 17, 2022.

(51) Int. Cl.

| | |
|---|---|
| ***G06K 17/00*** | (2006.01) |
| ***D06F 89/02*** | (2006.01) |
| ***D06F 93/00*** | (2006.01) |

(52) U.S. Cl.

CPC ..... *D06F 93/005* (2013.01); *D06F 89/026* (2013.01)

(58) Field of Classification Search

CPC ..... D06F 93/00; D06F 2105/58; D06F 33/32; D06F 93/005; D06F 89/026; G06K 19/027; G06K 7/10366

USPC ..... 235/375, 380

See application file for complete search history.

(56) References Cited

U.S. PATENT DOCUMENTS

| | | | | |
|---|---|---|---|---|
| 5,499,466 | A * | 3/1996 | House | A47G 25/1428 40/322 |
| 2005/0102734 | A1* | 5/2005 | Daniel | A41B 11/002 2/239 |
| 2010/0077640 | A1* | 4/2010 | Randall | B42F 5/00 8/142 |
| 2011/0023342 | A1* | 2/2011 | Davidson | G09F 3/10 493/405 |
| 2016/0275775 | A1* | 9/2016 | Glasgow | G06K 7/10366 |
| 2017/0162082 | A1* | 6/2017 | Kunz | G09F 3/12 |
| 2019/0133201 | A1* | 5/2019 | Dochter | A41B 11/002 |

FOREIGN PATENT DOCUMENTS

| | | | | |
|---|---|---|---|---|
| CN | 208954493 | * | 6/2019 | G06F 3/02 |
| GB | 2405855 | * | 3/2005 | D06H 1/04 |
| WO | 2017042408 | * | 3/2017 | G06K 19/027 |

* cited by examiner

*Primary Examiner* — Daniel St Cyr

(74) *Attorney, Agent, or Firm* — Wood Herron & Evans LLP

(57) ABSTRACT

A method for using a tag to orient a garment is disclosed. The method includes identifying the tag on an outside portion of the garment. The method further includes identifying one or more characteristics of the tag. The method further includes identifying an orientation of the garment based on at least one of: the tag being on the outside portion of the garment and one or more characteristics of the tag. In response to identifying the orientation of the garment, the method further includes making contact with the tag. While making contact with the tag, the method further includes manipulating a position of the garment as part of a task relating to wardrobe management.

18 Claims, 16 Drawing Sheets

66

| Order | Garment Type | Tag Location |
|---|---|---|
| 1 | Gender Specific Underwear | Standard location |
| 2 | Pull - Down Garments (t-shirts, etc.) | Center - lower - back |
| 3 | Pull - Up Garments (No fastener) | Center - upper - back |
| 4 | Socks | Center - upper - back |
| 5 | Pull - Up Garments (Fastener) | Center - upper - back |
| 6 | Footwear | Center - upper - back |
| 7 | Belt | Standard location |
| 8 | Shirt/Jacket/etc. | Center - upper - back, near collar or top edge of garment |
| 9 | Gloves | Center - lower - inner |
| 10 | Neckwear | Center - back |

FIG. 4

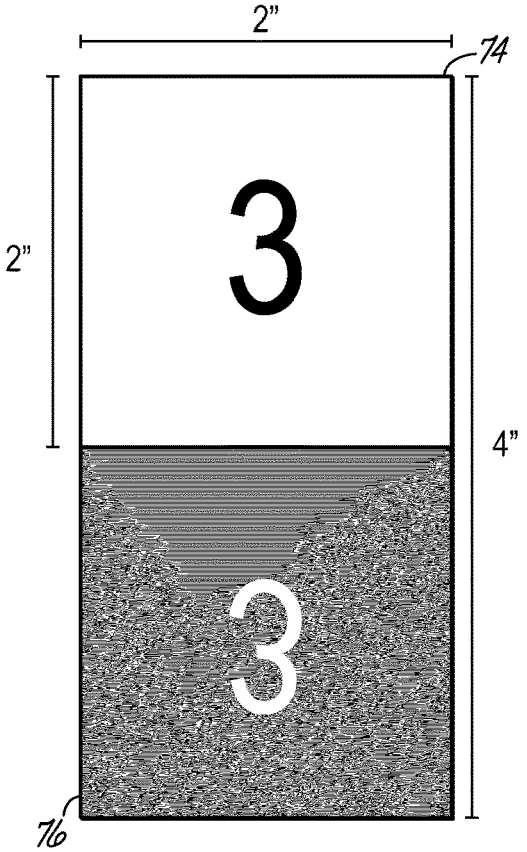
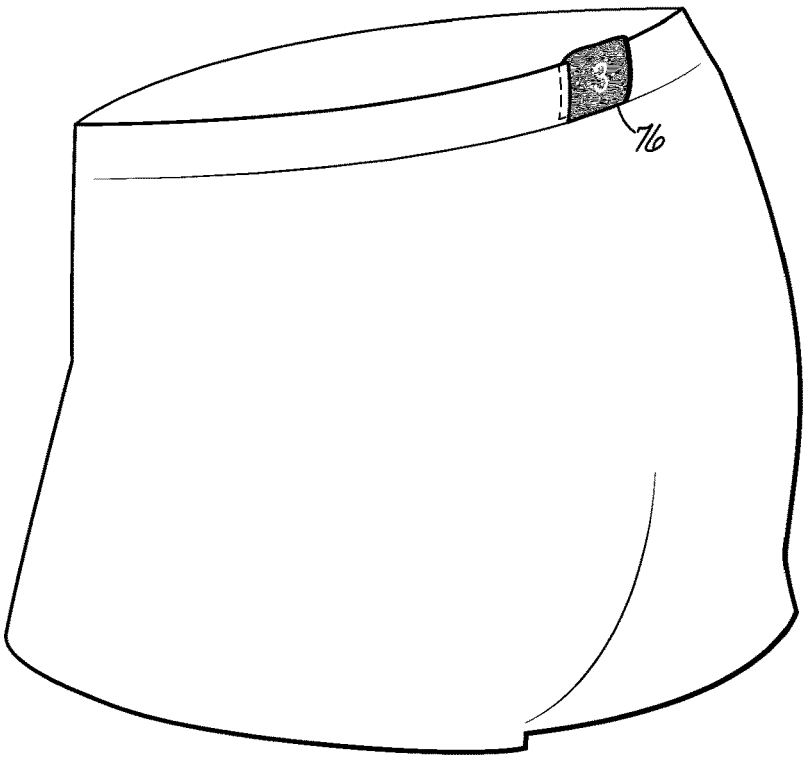
FIG. 6B

SYSTEM FOR INDEXING AND ORIENTING GARMENTS

RELATED APPLICATION

This application claims priority to U.S. Provisional Patent Application Ser. No. 63/364,819 filed May 17, 2022, entitled "Clothing Indexing and Auto-Orienting Tag System," the disclosure of which is hereby incorporated herein by reference, in its entirety.

FIELD OF THE INVENTION

The present invention relates generally to wardrobe management, and more particularly, to a wardrobe management system for indexing and orienting garments.

BACKGROUND

Tags on garments have been around for centuries, serving a variety of purposes. For example, in the early 1900s, tags typically included basic information such as the name of the manufacturer and the size of the garment. As clothing production became more standardized, tags were developed that included additional information such as the country of origin, fabric content, and fabric care instructions. In the 1960s and 1970s, tags began including information on the environmental impact of the garment and the materials used in production. In the 1980s, certain manufacturers began including fold lines on the tags to assist individuals in folding and storing their garments more efficiently. Tags have also evolved with technology. For example, in more recent years, tags have been developed that include quick response (QR) codes to provide individuals with additional information about the garment. Other tags have been developed that use smart tags to track the usage of the garment such that tailored fabric care instructions can be provided based on the garment usage.

Tasks relating to wardrobe management include folding garments, storing garments (e.g., hanging up clothing items or placing them into storage), putting on garments, taking off garments, and/or the like. For many individuals, a task, such as selecting and putting on a garment, is a simple, straightforward task. However, when an individual is not relying on an efficient, well-versed process to perform the task, a surprising amount of mental energy and attention is required. Furthermore, these tasks are not always straightforward for individuals with disabilities, such as individuals who are blind, have lost one or more limbs, and/or the like. Still further, in some situations, there is value in putting on a garment as quickly as possible. For example, if military troops in a combat zone are awaken in response to an attack, getting dressed quickly may be a matter of life or death.

It is an object of the invention to mitigate or overcome some or all of the problems described above.

SUMMARY

In an aspect of the invention, a method for using a tag to orient a garment is disclosed. The method includes identifying the tag on an outside portion of the garment. The method further includes identifying one or more characteristics of the tag. The method further includes identifying an orientation of the garment based on at least one of: the tag being on the outside portion of the garment and one or more characteristics of the tag. As used herein, identifying the orientation may include identifying the relative position of the garment (e.g., relative to the user or another known reference point). In response to identifying the orientation of the garment, the method further includes making contact with the tag. While making contact with the tag, the method further includes manipulating a position of the garment as part of a task relating to wardrobe management.

In an embodiment of the invention, when identifying the tag, the method includes identifying the tag based on the tag having a characteristic, of the one or more characteristics, that contrasts with a corresponding characteristic of the garment.

In another embodiment of the invention, a location of the tag is on the outside portion of the garment and is further defined as being in a central position on a back side of the garment. In this embodiment, when identifying the orientation of the garment, the method includes identifying the orientation of the garment based on the location of the tag. The central position may, for example, be defined as a position in which the tag is centered between two endpoints of a side of the garment. For example, the back side of the garment may be defined as having two opposing endpoints (e.g., where the distance between them represents a dimension such as a width of the garment). In this example, the tag may be said to be in a central position because the tag is positioned evenly between each opposing endpoint.

In another embodiment of the invention, the set of tag characteristics include at least one of a shape of the tag, a size of the tag, a color of the tag, a texture of the tag, and a mark of the tag.

In another embodiment of the invention, when identifying the orientation of the garment, the method includes identifying an orientation of the tag based on one or more directional indicators associated with at least one of the one or more characteristics of the tag, and identifying the orientation of the garment based on the orientation of the tag. To provide a specific example, a characteristic of a tag may be that the tag has a mark. The mark may include one or more characters (e.g., a letter, a number, a symbol, etc.). In this example, by viewing the mark, the user is able to identify the orientation of the tag (e.g., because the user will recognize whether the characters in the mark are right side up, upside down, etc.). As such, the directional indicators (e.g., specific directional orientations) may be said to be associated with the characteristic of the tag.

In another embodiment of the invention, when identifying the orientation of the garment, the method includes identifying a side of the garment as a front side, a back side, a top side, or a bottom side, based on at least one of the one or more characteristics of the tag, and identifying the orientation of the garment based on identifying the side of the garment.

In another embodiment of the invention, the task relating to wardrobe management includes at least one of: folding the garment, storing the garment, and wearing the garment In another aspect of the invention, a method of using a set of tags to orient one or more garments is disclosed. The method includes identifying a tag, of the set of tags, on an outside portion of a garment of the one or more garments. The method further includes identifying one or more characteristics of the tag. The method further includes identifying an orientation of the garment based on at least one of: the tag being on the outside portion of the garment, and one or more characteristics of the tag. In response to identifying the orientation of the garment, the method further includes making contact with the tag. While maintaining contact with the tag, the method further includes manipulating a position of the garment as part of a task relating to wardrobe management.

In an embodiment of the invention, the one or more garments are a plurality of garments, the garment is a first garment, and the first garment is a first type of garment. One or more other garments, of the plurality garments, are a second type of garment. The first garment and the one or more other garments share at least one garment characteristic. In this embodiment, after identifying the one or more characteristics of the tag of the first garment, the method further includes selecting the first garment, from the plurality of garments, as a target garment to which the task relating to wardrobe management is to be performed. Selection of the first garment is based on the tag having at least one characteristic, of the one or more characteristics, that is different than a corresponding characteristic of other tags located on the one or more other garments. In some embodiments, selecting the first garment, from the plurality of garments, is based on the tag having a location on the first garment that is different than a corresponding location of other tags on the one or more other garments.

In another aspect of the invention, a garment ensemble is disclosed. The garment ensemble includes one or more garments each having an inside portion, an outside portion, a front side, and a back side. The garment ensemble further includes one or more tags attached to the one or more garments. Each respective tag is positioned on the outside portion of the back side of a corresponding garment. Each respective tag includes one or more characteristics indicative of an orientation of the corresponding garment.

In an embodiment of the invention, a tag, of the one or more tags, includes a mark that identifies an orientation of the tag. The orientation of the tag is indicative of the orientation of the corresponding garment.

In another embodiment of the invention, at least one characteristic, of the one or more characteristics of each respective tag, contrasts with at least one characteristic of the corresponding garment.

In another embodiment of the invention, the one or more tags are a plurality of tags and the one or more garments are a plurality of garments. In this embodiment, a tag, of the plurality of tags, has at least one characteristic that distinguishes the tag from one or more other tags of the plurality of tags.

In another embodiment of the invention, the one or more garments include at least one of a pull-down garment, a pull-up garment, a pull-in garment, socks, footwear, gloves, neckwear, and headwear.

In this way, one or more of the disclosed embodiments allow an individual to put on a garment in a way that reduces the number of interactions with the garment (e.g., relative to a conventional method used to put on that garment). For example, rather than have to pick up and manipulate a position of a garment multiple times (e.g., to orient the garment properly), a user only has to grab the tag and perform a single manipulation. Overall efficiency is improved because the process only requires the user to perform a single, passive, visual (or tactile) step (although this may be described as two sub-steps, such as identifying a tag and identifying characteristics of the tag), followed by a single, active, manual manipulation. This allows the individual to decrease the amount of time and mental energy required to get dressed, increases the confidence and independence of the individual by making the processes of folding, storing, and/or putting on garments easier and less stressful, and reduces the need for the individual to rely on support from others (e.g., which may be the case if the individual has a disability). Furthermore, in military uses, such as when troops are in an active combat zone, significantly reducing the time needed to get dressed can mean the difference of life and death.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

FIG. 4 is a diagram of an example framework for putting on garments in an ensemble.

FIG. 6B is a diagram illustrating a set of two connecting tags and the positions of each respective tag on the underwear.

DETAILED DESCRIPTION

Figure 1:
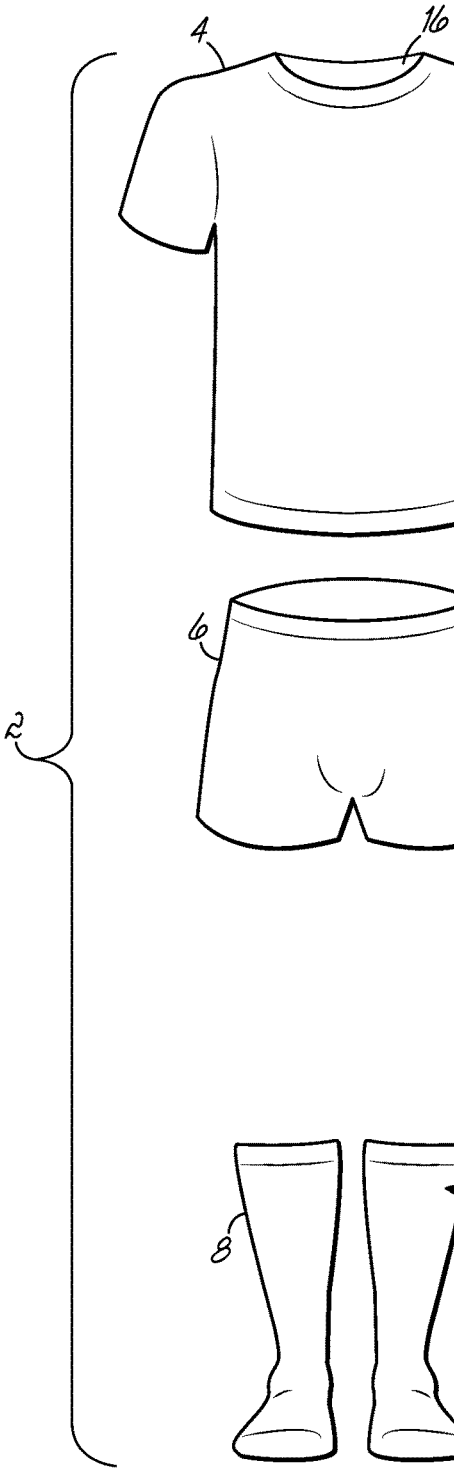
FIG. 1 is a front view of an ensemble of garments.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like.

As used herein, the term "user" may refer to an individual that is performing a wardrobe management task, such as folding one or more garments, storing one or more garments, putting on one or more garments, and/or the like.

Some embodiments described herein include a wardrobe management system that uses tags attached to garments to assist a user with orienting one or more garments. A garment may be oriented such that the user is able to manipulate the garment to perform a particular wardrobe management task. For example, assume the user has a pile of clean laundry. To fold and hang up a garment, the user first has to select the garment from the pile of clothes. Next, the user has to grab and orient the garment such that the garment can be put away. Without the wardrobe management system described herein, the user may have to perform multiple physical manipulations of the garment to orient the garment to a position suitable for being put away.

The wardrobe management system may include a set of tags that are placed in specific locations on each respective garment. Furthermore, the set of tags can include a variety of different characteristics, including different shapes, sizes, colors, and/or textures, and can include a variety of different markings (e.g., words, numbers, symbols, etc.). As will be explained, by placing tags in specific locations on each respective garment, and by using tags with characteristics that fit the needs of a particular user and/or situation, the wardrobe management system allows a user to efficiently and effectively fold the one or more garments, store the one or more garments, and/or put on (i.e., wear) the one or more garments. In this way, the user is able to quickly identify a tag on a garment, grab hold of the tag, and follow a protocol that allows the user efficiently and/or effectively orient the garment into the requisite position needed for folding, storage, and/or wearing.

The terms "efficiency" and "effectiveness", as seen above and described herein, are used to describe one or more of the methods/processes/protocols used herein. These terms may be measured based on the time needed to perform a wardrobe management task, the number of manipulations required by the user, the range of motion of the user when performing the manipulations, the amount of mental energy required to perform the steps (e.g., which could, for example, be measured quantitatively by the number of steps that the user has to think about), and/or by using any other measurement strategy known in the art.

Figure 2:
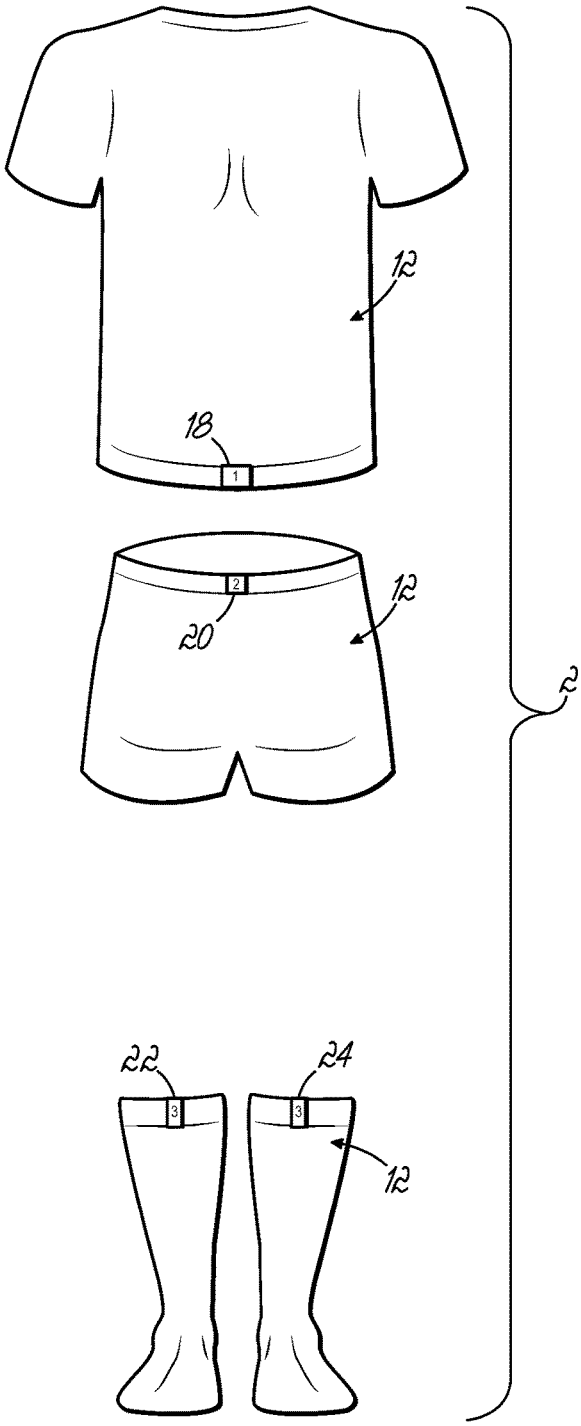
FIG. 2 is a rear view of the ensemble of garments.

FIGS. 1 and 2 show an ensemble 2 of garments that include a set of tags designed to assist in indexing and/or orienting each respective garment. FIG. 1 is a front view of the ensemble 2 of garments. The ensemble 2 (sometimes referred to as a garment ensemble) includes a t-shirt 4, underwear 6, and socks 8. This is provided by way of example, and in practice, the ensemble 2 may include any number of different types of garments, including a piece of gender-specific clothing (e.g., a brassiere, etc.), a pull-down garment, a pull-up garment, a pull-in garment that uses a fastener, a fastener for supporting pants and/or shorts (e.g., a belt), handwear, headwear/neckwear, another type of garment, and/or a combination thereof. The pull-down garment may include a t-shirt, a short-sleeved shirt, a long-sleeved shirt, a sweatshirt, and/or another type of garment that is pulled over the user and/or has a continuous neck opening or sleeve. A pull-up garment may include pants, shorts, swim trunks, a skirt, and/or another garment that is put on by pulling the garment upward over the user. A pull-in garment that uses a fastener may include a button-up shirt, a zip-up jacket, and/or another type of garment with a closure that is sealed using a fastener. Headwear/neckwear may include a hat, eyewear, a scarf, and/or the like.

One or more of the garments described herein may be said to have a front side 10, a back side 12, an outside portion 14, and an inside portion 16. FIG. 1 shows the front side 10 of the t-shirt 4, the underwear 6, and the socks 8.

FIG. 2 is a rear view of the ensemble 2 of garments. To utilize a wardrobe management system for indexing and/or orienting garments, a set of tags may be placed in specific locations on each respective garment. Example locations are provided further herein. Each tag may include a variety of characteristics, including shapes, sizes, colors, textures, and/or markings (e.g., words, numbers, symbols, etc.). Examples of tag characteristics are provided in connection with FIGS. 3A-3E.

As used herein, the term "tag" refers to a collection of fibers (or related materials) that are attached to or part of a garment. In some embodiments, the tag may be a separate piece of fabric from the remainder of the garment. In this case, the tag may be attached to the garment using one or more fabric-attachment methods described further herein. In some embodiments, the tag and the garment may be part of the same piece of fabric. For example, the fibers of the tag may be stitched or sewn directly into the garment, such that the tag is part of the fabric of the garment.

In some embodiments, the characteristics of a tag may be chosen based on the ease by which a user is able to recognize the tag. Additionally, or alternatively, the characteristics of the tag may be selected based on the ease with which the tag is able to convey information with minimal cognitive effort.

The speed at which a user can identify the tag, and the user's ability to effectively orient the garment (e.g., which can be measured based on how many times the user has to touch and/or alter a position of the garment in his or her hands), are directly affected by the characteristics of the tag. Extensive product research was performed to identify preferred tag locations on each respective garment. For example, chalk was placed onto the hands of a tester, who performed thousands of manual manipulations of garments that had tags in different locations on each respective garment. Test results showed that the number of times that garments had to be touched or manipulated before being put on increased in cases where the garments were more homogeneous in nature. For example, test results showed that when sorting the same color clothing of different types (e.g., which is common when doing laundry), tags placed in conventional locations (e.g., such as on the inside of a garment) required an average of 300% more manual manipulation (e.g., relative to tag locations described herein) to identify the inside/outside and front side/back side of garments for putting on and/or for storing.

Furthermore, the chalk test data described above produced two kinds of chalk marks. First, "orienting" chalk marks were found on outside of garments. The orienting chalk marks were inconsistent (e.g., less frequent), with few recognizable patterns found. One observed pattern is that these orienting chalk marks occurred, with at least some degree of frequency, as a visible regional clusters of chalk marks. Regional clustering may refer to a condensed occurrence of chalk marks in certain areas of a garment, and could, for example, occur when a user is manipulating the garment to position the garment in the desired orientation needed to put it on and use it. Second, "donning" chalk marks were found. Donning chalk marks were more consistent (relative to orienting chalk marks) and formed patterns left after putting on garments.

The net results of many tests produced an optimized narrow perspective on achieving and expressing a mathematically efficient use of clothing as measured by the total amount of manipulations and attention required to orient garments to a preferred position such that the garments can be used when performing various wardrobe management tasks.

To orient a t-shirt so it can be interacted with ambidextrously and efficiently, the optimal location for the tag is in a central position on the lower edge portion of the of the back side of the garment. This can be seen in FIG. 2, where the t-shirt 4 includes a tag 18 that is located in a central position on the lower edge portion of the back side 12 of the t-shirt 4.

To orient briefs and socks so that each can be interacted with ambidextrously and efficiently, the optimal location for the tag is in a central position on a top edge portion of the back side of the garment. This can also be seen in FIG. 2, where the briefs 6 include a tag 20, and the socks 8 each include a tag (tag 22, 24), that are each located in a central position on a top edge portion of the back side 12 of the garment. It was observed over hundreds of consecutive tests that this location on these items allowed the user to grab the tag with one hand while allowing the other hand to orient the garment in one motion to assist in immediately putting the garment on. Furthermore, if the garment is placed into storage, the garment can then be folded, hung, or otherwise stored so that the tag is accessible to put the garment on efficiently later.

Figure 3A:
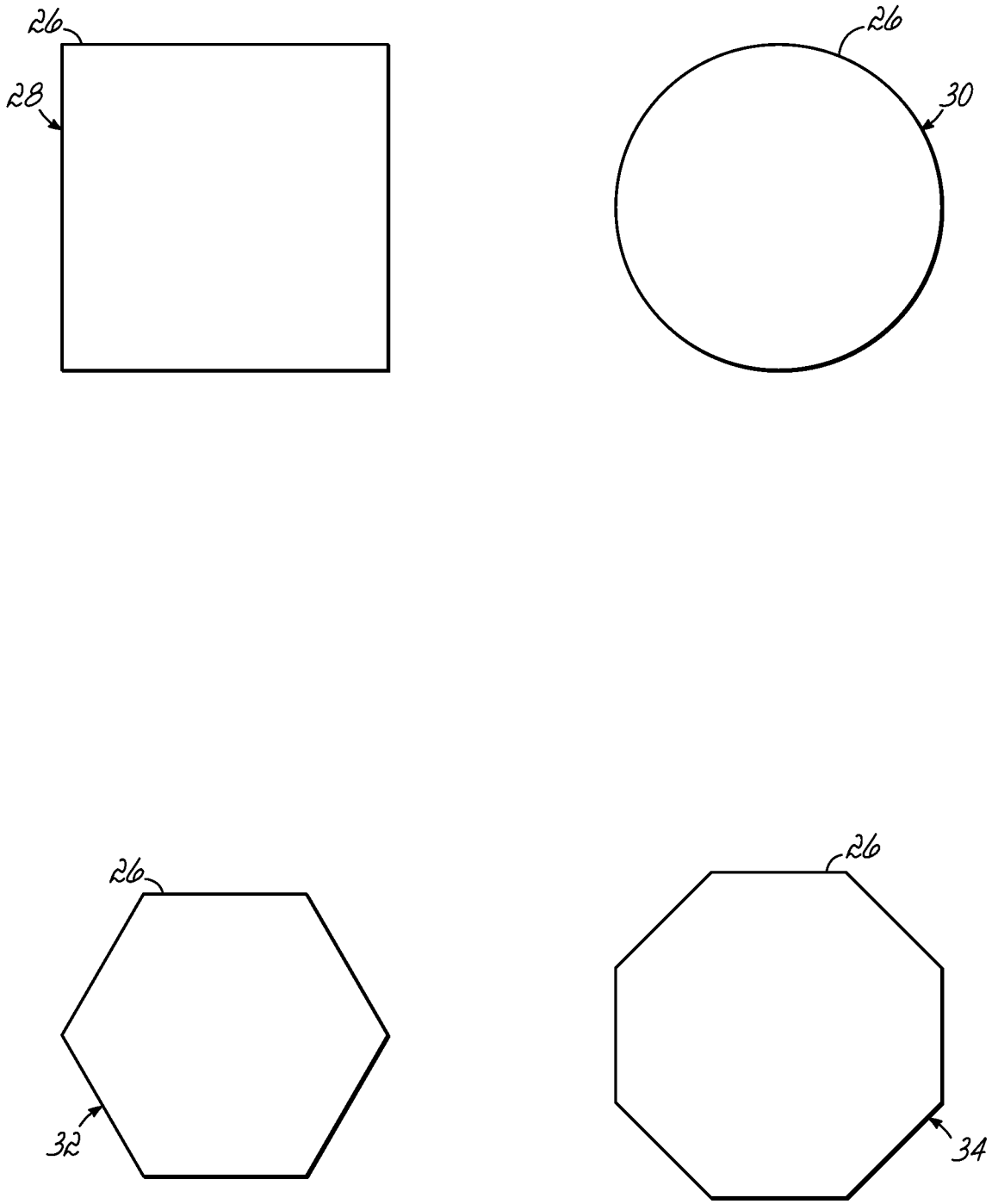
FIG. 3A is a diagram illustrating one or more example shapes of a tag in accordance with the principles of the present disclosure.

FIGS. 3A-3E illustrate variations in characteristics of a tag 26. For example, FIG. 3A is a diagram illustrating one or more example shapes of the tag 26 in accordance with the principles of the present disclosure. In some embodiments, the shape of a tag, such as the tag 26, may indicate a particular type of garment. In some embodiments, the same shape may be used for multiple types of garments. In some embodiments, the number of different shapes utilized for an ensemble or collection of garments may depend on the needs of the user. For example, a user who is vision impaired may require an increased number of shapes on his or her garments to better differentiate the tags from each other.

In FIG. 3A, the tag 26 is shown as having four different shapes. In some embodiments, the tag 26 may have a shape that protrudes from the edge of the garment. In some embodiments, the tag may have a shape that does not protrude from the edge of the garment (e.g., such that an edge of the tag corresponds to an edge of the garment). As shown in FIG. 3A, the tag 26 may be a first shape 28, such as a square or rectangle. To provide another example, the tag 26 may have a second shape 30, such as a circle. The circle may have a portion protruding from the top edge of the garment or may be affixed to the garment's underside, depending on the type of garment. In some embodiments, the protruding portion may be a portion that is less than a half circle. In some embodiments, the portion protruding from the top edge may be made using a smooth material. To provide another example (not shown), the tag 26 may have a half circle as a shape.

To provide another example, the tag 26 may have a third shape 32, such as a hexagon. In some embodiments, the hexagon may have a portion protruding from the edge of the garment and may have a slope ending in a point with a slope down to the other edge of the tag. This could be a hexagon or the portion below the edge of the garment could be a partial hexagon.

To provide another example, the tag 26 may have a fourth shape 34, such as an octagon. In some embodiments, the octagon may have a portion protruding from the garment edge and would have a distinctive, flat, slope (which could be traced using the user's finger). The rest of the tag, which may be affixed below the surface of the garment, could still be a rectangle (e.g., which is why it is referred to as a partial octagon).

These shapes are provided by example. In practice, other shapes may be selected and the shapes selected may be developed for a particular user, group of users, and/or situation. For example, a tag with a non-uniform edge may be used to indicate right or left for shoes, boots, or gloves. One half of the tag may be flat and the other has a bump or a right triangle to help orient the corresponding garment.

Figure 3B:
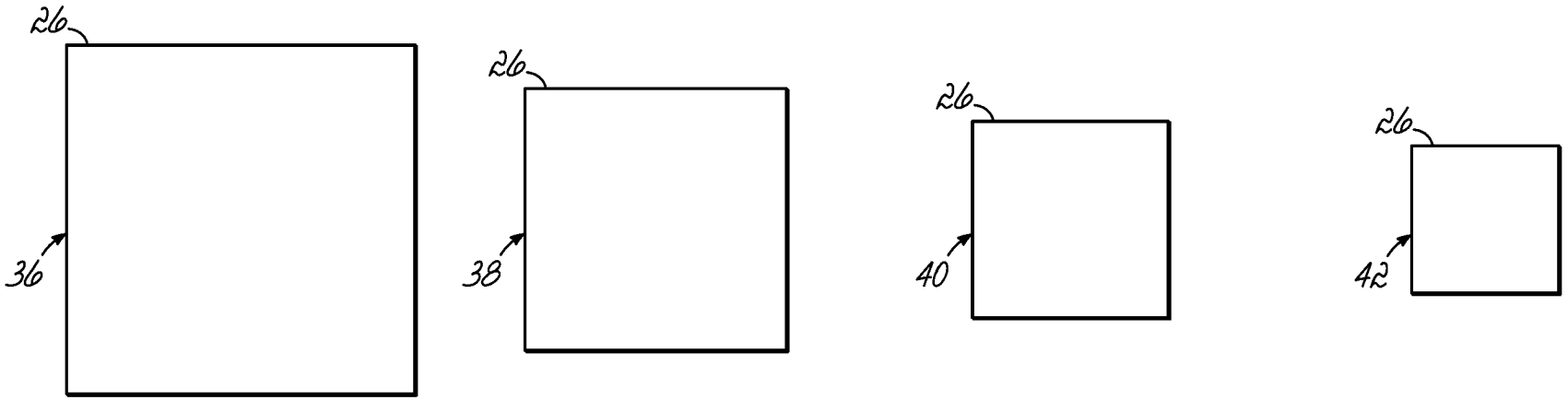
FIG. 3B is a diagram illustrating one or more example shapes of the tag in accordance with the principles of the present disclosure.

FIG. 3B is a diagram illustrating one or more example sizes of the tag in accordance with the principles of the present disclosure. In FIG. 3B, the tag 26 is shown as having four different sizes. For example, the tag 26 may have a first size 36, a second size 38, a third size 40, and a fourth size 42. In some embodiments, different sizes of tags may be used for different garments. Additionally, or alternatively, different sizes of tags may be applied to different applications to accommodate users with different needs.

Figure 3C:
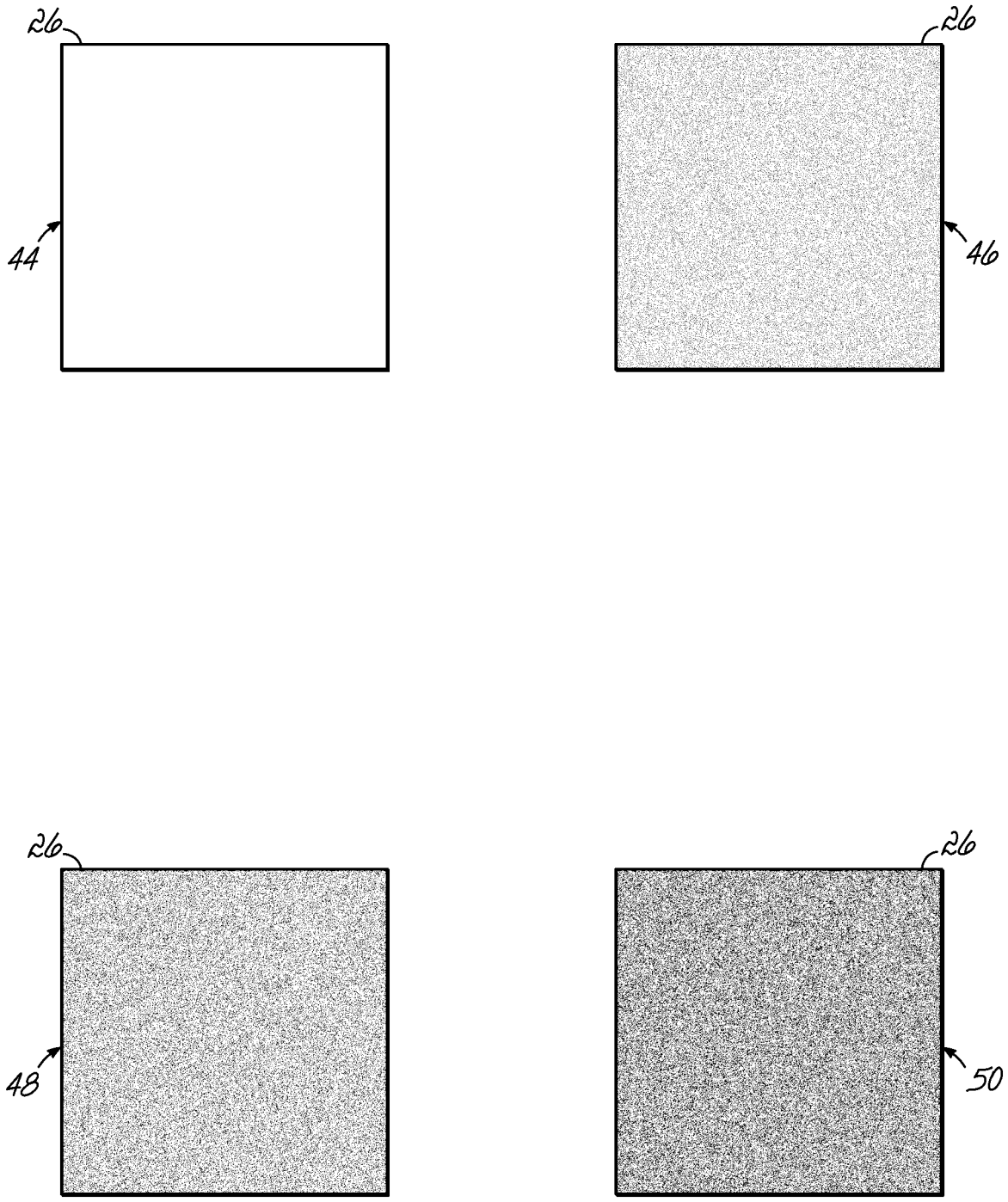
FIG. 3C is a diagram illustrating one or more example sizes of the tag in accordance with the principles of the present disclosure.

FIG. 3C is a diagram illustrating one or more example colors of the tag 26 in accordance with the principles of the present disclosure. In FIG. 3C, the tag 26 is shown as having four different colors. For example, the tag 26 may have a first color 44, a second color 46, a third color 48, and a fourth color 50. Each respective color is shown in the figures using a different shade of gray. In some embodiments, different colors of tags may be used for different garments. Additionally, or alternatively, different colors of tags may be applied to different applications to accommodate users with different needs.

Figure 3D:
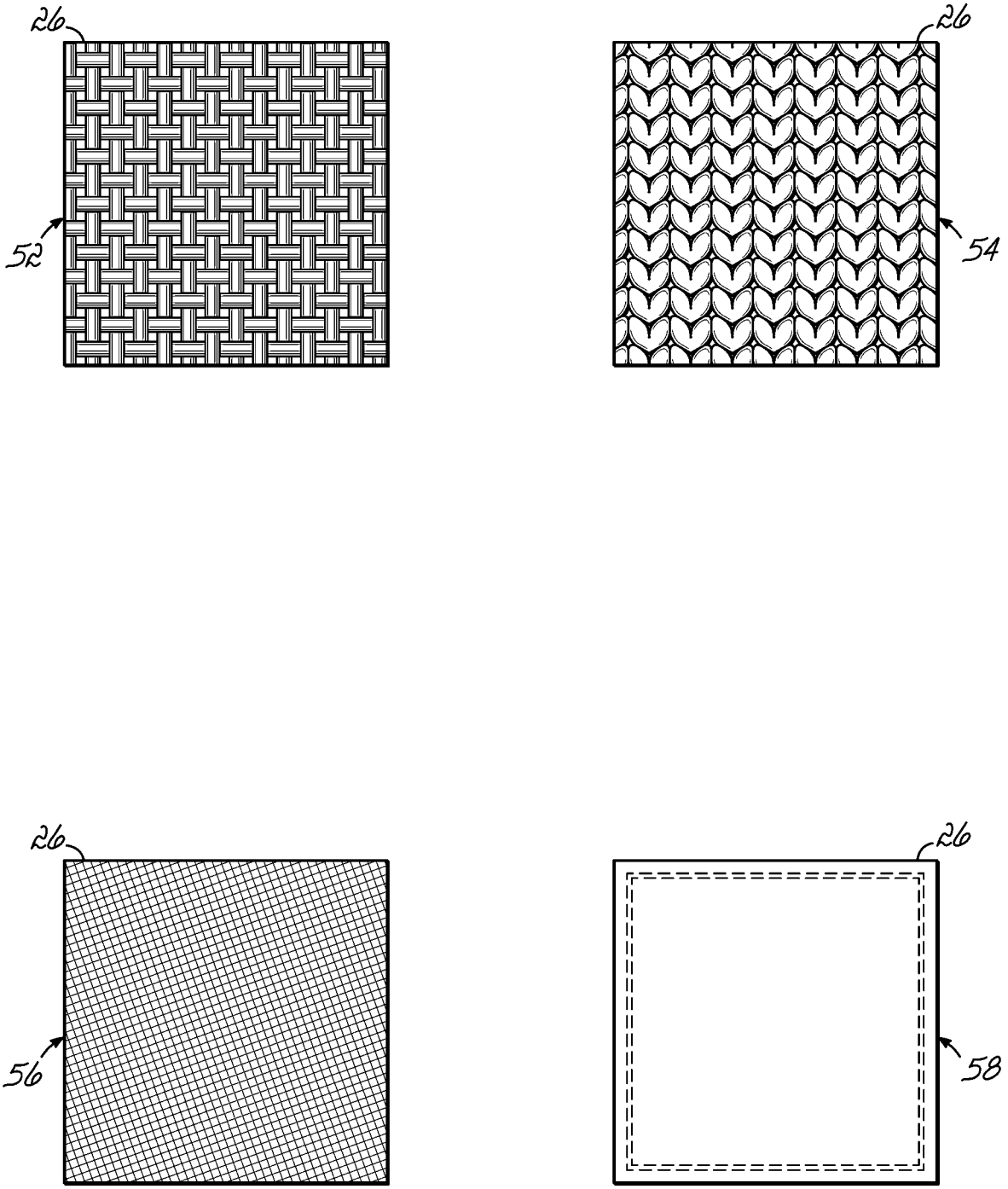
FIG. 3D is a diagram illustrating one or more example colors of the tag in accordance with the principles of the present disclosure.

FIG. 3D is a diagram illustrating one or more example fabric textures of the tag 26 in accordance with the principles of the present disclosure. In FIG. 3D, the tag 26 is shown as having four different textures. For example, the tag 26 may have a first texture 44, a second texture 46, a third texture 48, and a fourth texture 50. In some embodiments, different textures of tags may be used for different garments. Additionally, or alternatively, different textures of tags may be applied to different applications to accommodate users with different needs.

Figure 3E:
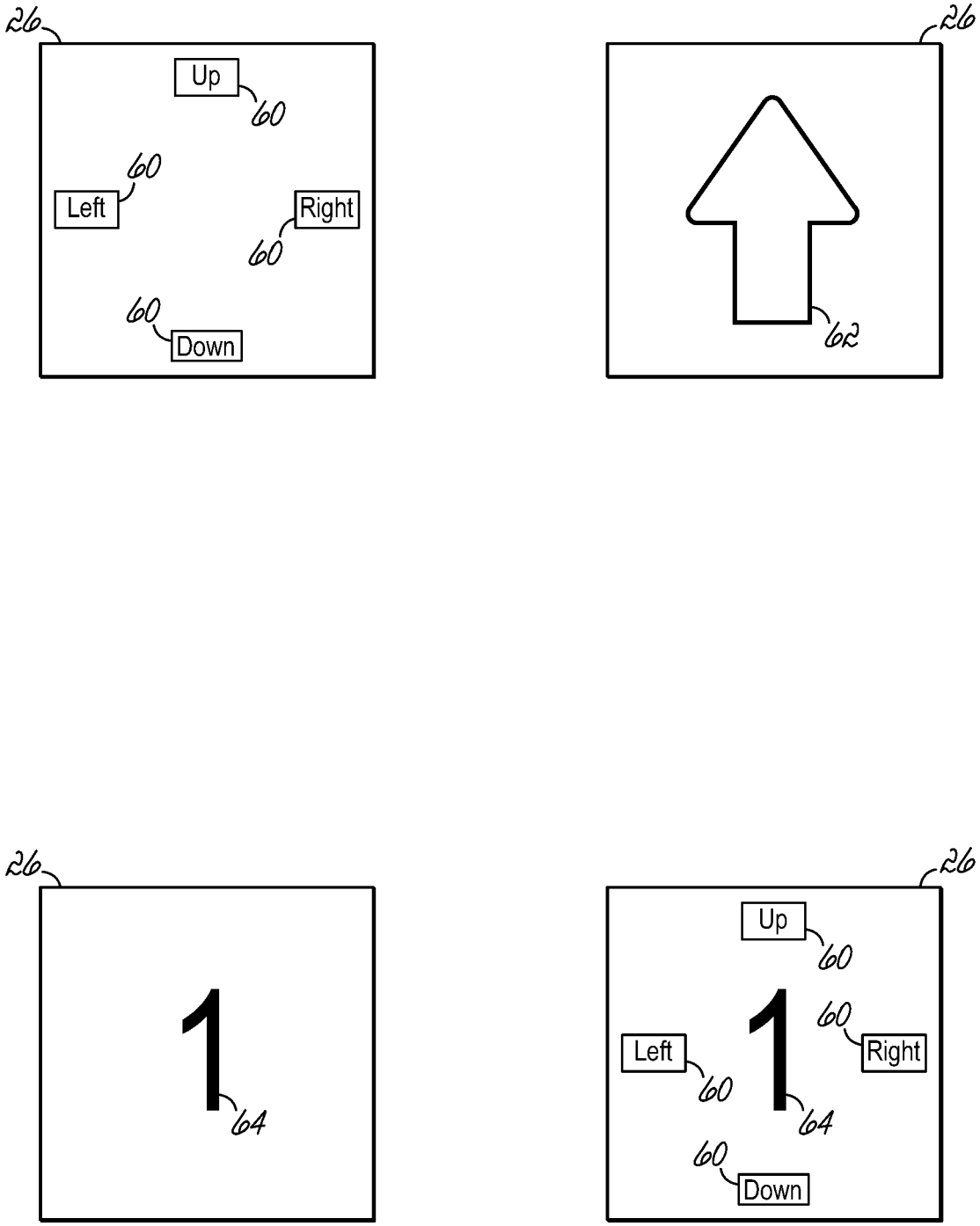
FIG. 3E is a diagram illustrating one or more example fabric types and/or textures of the tag in accordance with the principles of the present disclosure.

FIG. 3E is a diagram illustrating one or more example marks of the tag 26 in accordance with the principles of the present disclosure. In FIG. 3E, the tag 26 is shown as having four different marks. For example, the tag 26 may include a word mark. In the example shown, the word mark includes text specifying four different directions (up, down, left, right).

To provide another example, the tag 26 may include one or more symbols 62. In the example shown, the symbol is a directional arrow pointing upward. To provide another example, the tag 26 may include a numerical mark 64 (shown as the number one). To provide another example, a combination of marks may be used as part of the tag 26.

A mark may be applied to the tag by embroidery, embossing, stamping, punching, using heat transfer materials, manual sewing, silk screening, painting, cutting, and/or the like. During development of the wardrobe management system for the first 3 clothing types that the invention was applied to, different strategies were used such as grommets, stamping or embroidering letters or punching were used.

In some embodiments, a wardrobe management system may be implemented that utilizes tags with four characters that are stacked on top of three characters. This may provide sufficient capacity for indexing information while also being able to be easily read by tactile means and the orientation of the letters on the tag indicates up and down. The usage of the garments/tagging system could dictate the usage of the digits or other symbols, as well as tag shape and texture.

In some embodiments, a wardrobe management system may be implemented that includes two characters for clothing type, two characters or specialized symbols to indicate color, one character for size, and two characters for style, length of sleeve/pant leg, etc.

Not all types of clothing may require the same indexing complexity. For instance, socks may not require as much information to be communicated by a tag/mark than a coat or tee shirt. Furthermore, any number of different characteristics of the tag 26 may vary depending on the application and/or needs of the user.

In some embodiments, a tag may include a quick response (QR) code. For example, the mark on the tag may be a QR code and the QR code may permit a user to scan the QR code. This may cause a website or application to launch on a user device, such as a mobile phone. The website or application may provide the user with access to one or more protocols used to perform tasks such as folding garments, hanging up garments, putting on garments, and/or the like.

In some embodiments, the tag may include a smart tag. For example, the mark on the tag may be a smart tag and the smart tag may be used to perform a variety of functions relating to tracking and/or identifying information. In some embodiments, the smart tag may be part of a printed circuit board (PCB). The PCB may further include a processor and one or more light-emitting diodes (LEDs). By implementing smart tags on different types of garments, the LEDs are able to be configured such that a different color of light, different frequency of light, different duration of light, and/or the like, may be used for smart tags on each respective garment.

FIG. 4 is a diagram of an example framework 66 for putting on garments in an ensemble. Framework 66 provides an order in which a user can put on or remove garments. The order is based on the locations of respective tags and characteristics of respective tags. Furthermore, the order reduces the number of orientations or motions that a user has to make to put on garments.

In the example shown, the framework 66 specifies that a user is to put on garments in the following sequence: (1) gender-specific underwear, (2) pull-down garments, (3) underwear, (4) socks, (5) pants, (6) footwear, (7) belt, (8) garments using a fastener (e.g., shirt, jacket, etc.), (9) gloves, and (10) neckwear/headwear. First, a user may put on any gender-specific underwear, such as a brassiere or related garment that has be put on before a shirt. Second, the user may put on a pull-down garment, such as a t-shirt. In some embodiments, the tag of the pull-down garment may be located in a central position on the lower edge portion of the back side of the pull-down garment.

Third, the user may put on a pull-up garment that does not have a fastener, such as underwear. In some embodiments, the tag of the underwear may be located in a central position on the upper edge portion of the back side of the pull-up garment. Fourth, the user may put on socks. In some embodiments, the tag of the socks may be located in a central position on the upper edge portion of the back side of the socks.

Fifth, the user may put on a pull-up garment that does have a fastener, such as pants. In some embodiments, the tag of the pants may be located in a central position on the upper edge portion of the back side of the pull-up garment. Sixth, the user may put on footwear. In some embodiments, the tag of the footwear may be located in a central position on the upper edge portion of the back side of the footwear. In some embodiments, the tag of the footwear may have a non-uniform edge used to indicate left or right. Seventh, the user may put on a garment-fastener, such as a belt, spandex, etc.

Eighth, the user may put on pull-in garment that uses a fastener, such as a button-up shirt, zip-up jacket, etc. A pull-in garment may have no sleeves, short sleeves, three-quarter inch sleeves, and/or the like. In some embodiments, the tag of the pull-in garment may be located in a central position on the upper edge portion of the back side of the pull-in garment. For example, the tag may be located near the collar or top edge of the pull-in garment.

Ninth, the user may put on gloves. In some embodiments, the tag of the gloves may be located in a central position on the inner wrist edge of the gloves. In some embodiments, tags for gloves may have a shape with a non-uniform edge to indicate left and right. Tenth, the user may put on neckwear/headwear. In some embodiments, the tag of the neckwear may be located in a central position on the back side of the neckwear. In some embodiments, the location of the tag of the neckwear may need to modified for utilitarian use or visual appeal.

A hierarchy such as this could be used to create clothing packs for rapid deployment in crisis situations with clothing packed so that the tags are readily accessible. But a wardrobe management system such as this is also very flexible as it can be used to systematically index many different types of clothing.

Figure 5A:
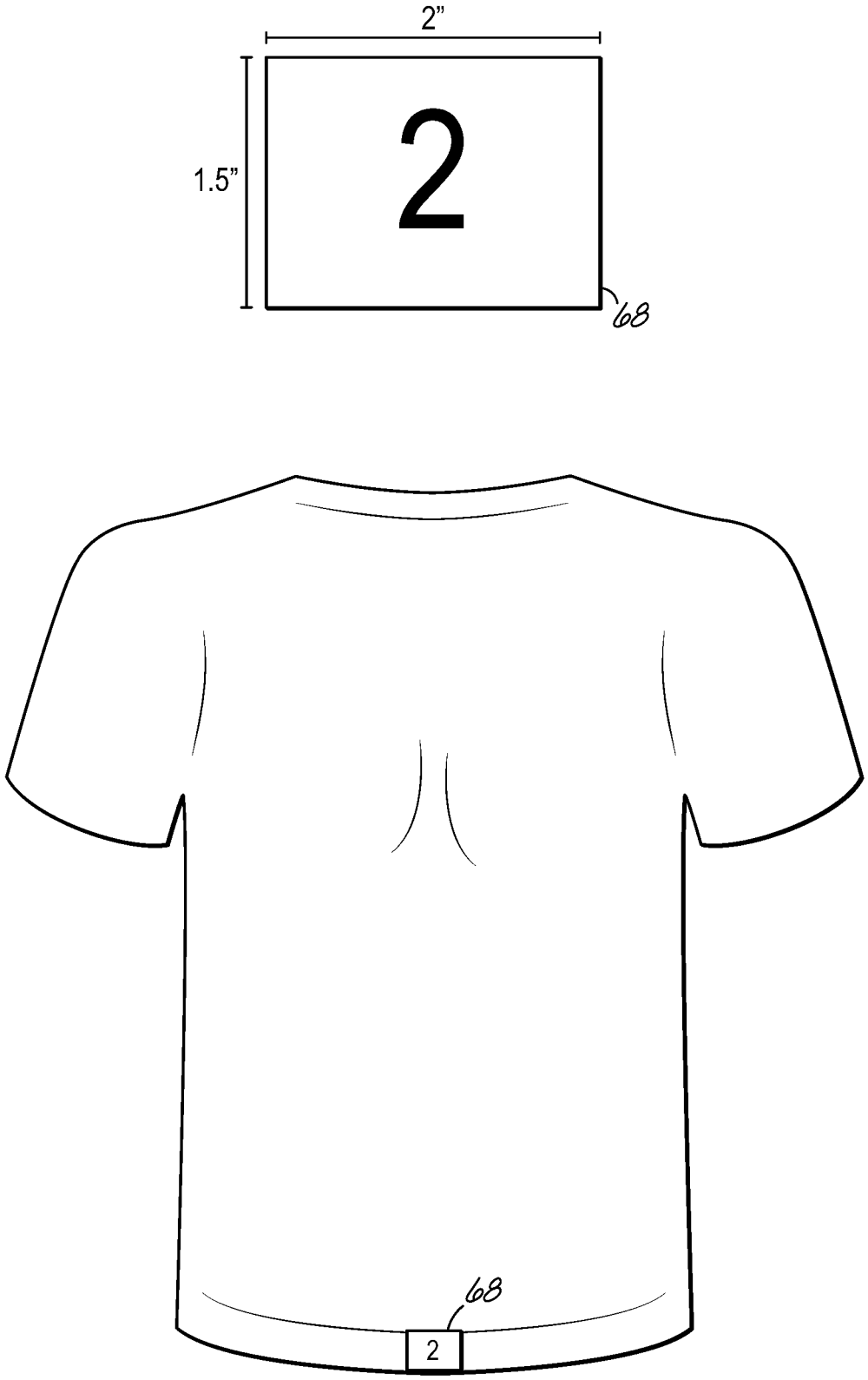
FIG. 5A is a diagram illustrating an example tag and the position of the tag on a t-shirt.

FIG. 5A is a diagram illustrating an example tag 68 and a position of the tag 68 on a t-shirt. As can be seen in FIG. 5A, the tag 68 is a rectangle with large, numerical text placed in a central position on the lower edge portion of the back side of the t-shirt. The dimensions of the tag 68 include a length of 1.5" and a width of 2.0". The text is monochromatic and has a color that contrasts with the background portion of the tag 68. Further, the text is enlarged to fill the entire tag 68. Furthermore, the text is placed in the center of an outwardly facing surface of the tag 68 (e.g., a surface that is visible from outside of the t-shirt). In some embodiments, the text may include branding information. In this case, it is recommended that the branding information be limited in scope and type so as to not detract from the ability of the tag 68 to be used to index and/or orient the t-shirt.

Figure 5B:
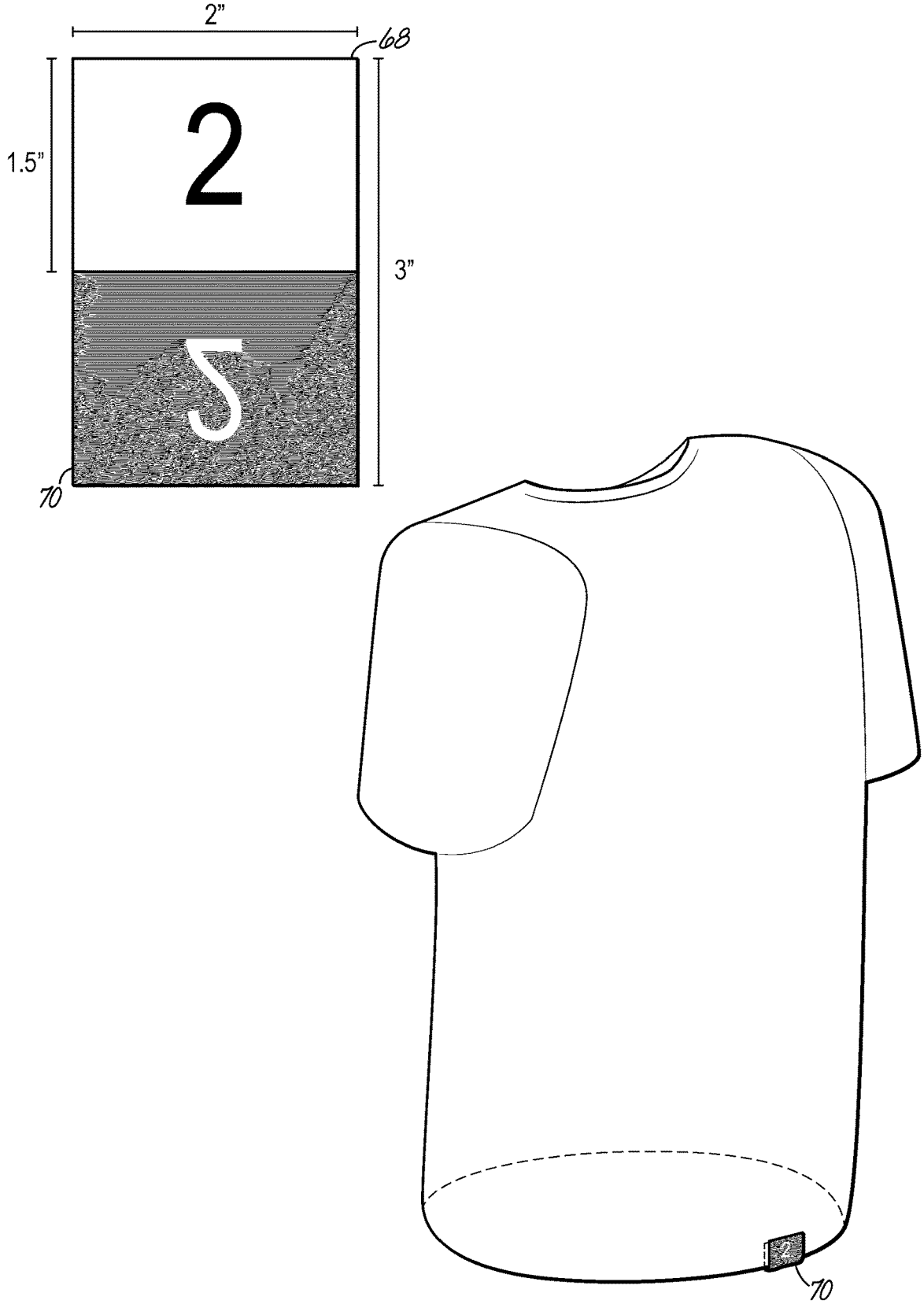
FIG. 5B is a diagram illustrating a set of two connecting tags and the positions of each respective tag on the t-shirt.

FIG. 5B is a diagram illustrating a set of two connecting tags and the positions of each respective tag on the t-shirt. The set of connecting tags may include tag 68 and tag 70. In the example shown, tag 68 and tag 70 may be the same size (e.g., with a length of 1.5" and a width of 2.0"). In some embodiments, the two connecting tags may have contrasting colors. In the example shown, the tag 68 may have a white background with black text and the tag 70 may have a black background with white text.

In some embodiments, a non-kit version of the tags may be constructed. In this case, the tags may be connected via stitched embroidery, screen printing, or even fabric pen. In some embodiments, a kit version of the tags may be constructed. In the kit version, the white and black sides may be folded opposite to one another and contrasted to the color of the garment. For example, the set of tags may be applied to a white t-shirt such that the black tag 70 is visibly located on the outside of the t-shirt (e.g., in a central position on the lower edge portion of the back side of the t-shirt). In this way, a user's eyes can be trained to respond to the maximum contrast of colors, allowing the user to efficiently and effectively index and/or orient the t-shirt.

By utilizing tags with these contrasting colors, a user is quickly able to identify and make contact with (e.g., grasp, grab, etc.) the tag. By providing an efficient way for the user to identify and grasp the tag, a repeatable protocol may be followed that provides the user with an efficient and effective way to perform wardrobe management tasks. One reason why this is more efficient is because the user only has to perform one physical manipulation of the garment (e.g., grasping the tag). Comparatively, without the wardrobe management system described herein, the user might inefficiently and/or ineffectively grab multiple parts of the garment while attempting to orient the garment to a position suitable for wearing.

Figure 5C:
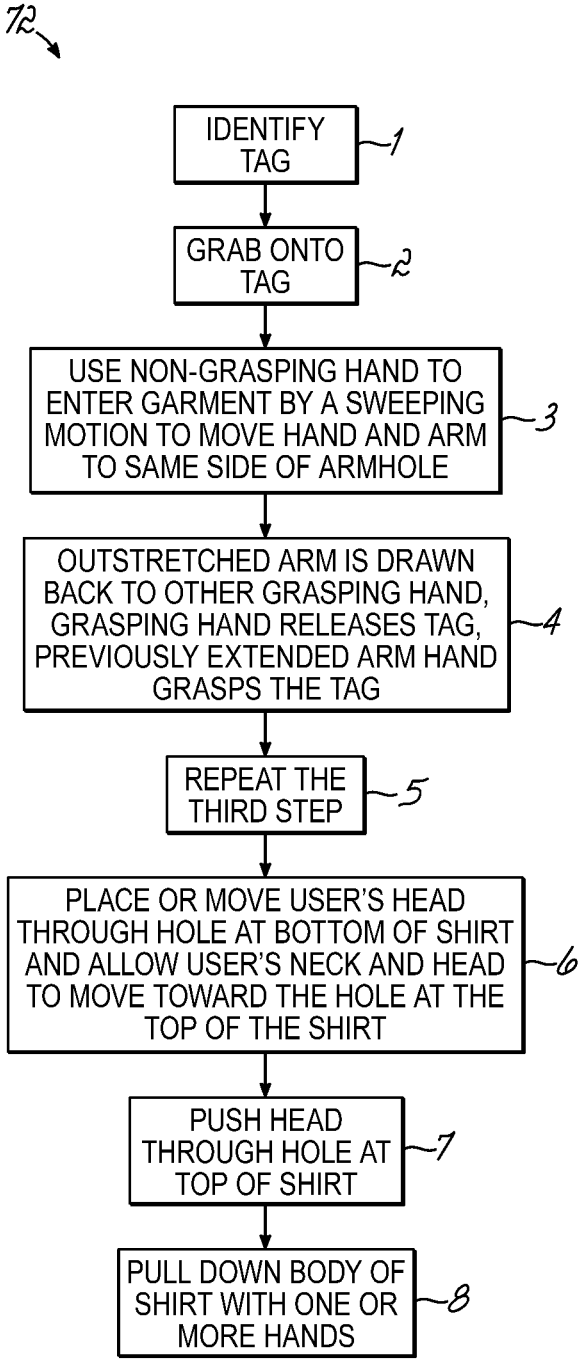
FIG. 5C is a flowchart of a protocol for using a tag to orient the t-shirt.

FIG. 5C is a flowchart of a protocol 72 for using a tag (e.g., tag 68 and/or tag 70) to orient the t-shirt. While the protocol is described as being applied to a t-shirt, it is to be understood that this protocol may be applied to one or more other types of garments, such as other pullover garments that do not have fasteners. Furthermore, one or more steps below describe identifying the tag visually and/or grasping the tag with a hand of the user. In situations where the user has a disability, or when a properly lit room is not readily available, one or more steps may be altered to fit the needs of the user and/or situation.

The first step in protocol 72 includes having a user visually identify the tag. The user may be more likely to quickly identify the tag based on the location of the tag being in an optimal location, based on the tag having characteristics that make the tag easily identifiable, and/or the like. The tag may, for example, be described as being in an "optimal" location because the location is optimal relative to other available locations. For example, a tag location on the outside of a garment is optimal relative to a tag location on the inside of the garment because the tag location on the outside of the garment is easier for the user to view. Other optimal locations described herein were determined by performing a series of garment orientation/manipulation tests, as is described elsewhere herein. The second step in protocol 72 includes having the user grab onto the tag. For example, the user may grab onto the tag using either hand. The user may be more likely to move or orient the t-shirt into a desired position based on applying a protocol (described in connection with FIG. 5C) that requires the user to initially grab onto the tag with either hand.

The third step in protocol 72 includes having the user use the non-grasping hand to enter the garment by using a sweeping motion to move that hand and arm to the same side armhole (right hand to right side, left hand to left side). The arm is extended to fill the arm hole of the garment and the grasping hand is pulled towards the user. The fourth step in protocol 72 includes having the outstretched arm of the user drawn back to the other grasping hand, having the grasping hand release the tag, and having the previously extended arm hand grasp the tag.

The fifth step in protocol 72 includes repeating the third step with the user's other arm. When the user's arm is fully extended during the fifth step, the sixth step includes placing or moving the user's head through the hole at the bottom of the t-shirt and allowing the user's neck and head to move toward the hole at the top of the t-shirt.

The seventh step in protocol 72 includes having the user push his or her head through the hole at the top of the t-shirt. The eighth step in protocol 72 includes having the user pull down the body of the shirt with one or both hands to its full extension, such that the t-shirt covers the user's body and rests in the appropriate position for wearing.

Figure 6A:
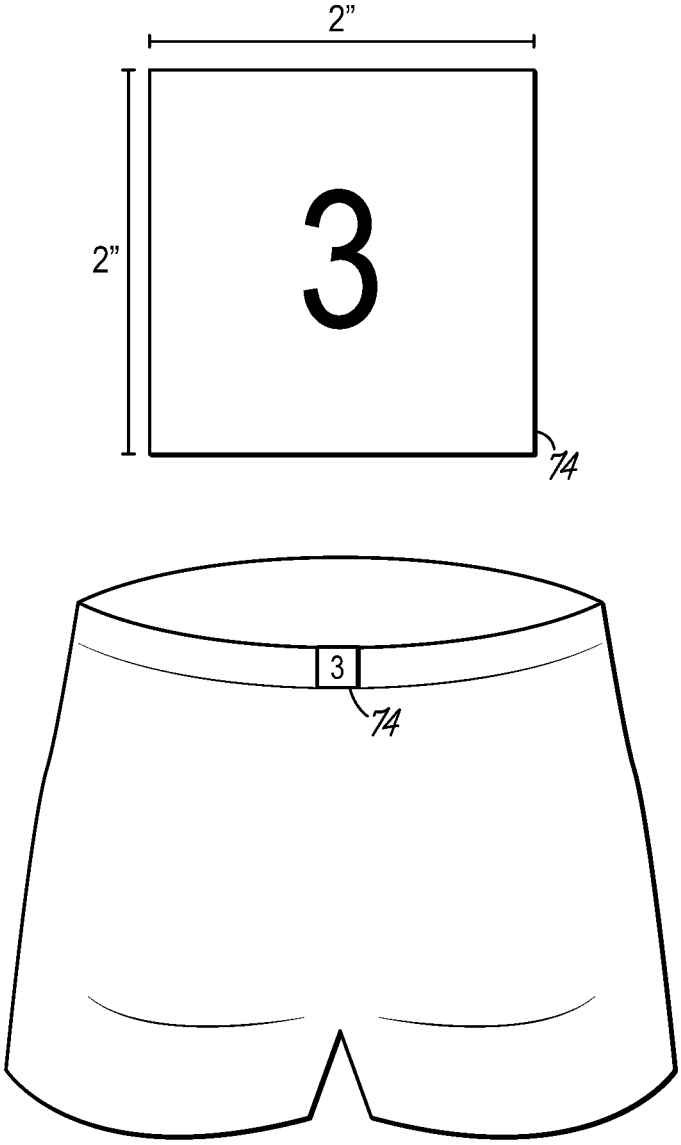
FIG. 6A is a diagram illustrating an example tag and the position of the tag on underwear.

FIG. 6A is a diagram illustrating an example tag 74 and a position of the tag 74 on socks. As can be seen in FIG. 6A, the tag 74 is a rectangle with large, numerical text placed in a central position on the upper edge portion of the back side of the underwear.

It is noted that while t-shirts are put on from the top side down, underwear is put on from the bottom side up. For this reason, the location of the tags, and the protocol used, is different. Furthermore, the tag geometry and dimensions were modified to assist the user in differentiating between different types of garments. In the example shown, the dimensions of the tag 68 include a length of 2.0" and a width of 2.0".

In some embodiments, the text may be monochromatic and have a color that contrasts with the background portion of the tag 74. Further, the text is enlarged to fill the entire tag 74. Furthermore, the text is placed in the center of an outwardly facing surface of the tag 74 (e.g., a surface that is visible from outside of the underwear). One or more of these characteristics allow the user to orient the underwear for use and to provide visual (or tactile) differentiation from other tags.

FIG. 6B is a diagram illustrating a set of two connecting tags and the positions of each respective tag on the underwear. The set of connecting tags may include tag 74 and tag 76. In the example shown, tag 74 and tag 76 may be the same size (e.g., with a length of 2.0" and a width of 2.0"). In some embodiments, the two connecting tags may have contrasting colors. In the example shown, the tag 74 may have a white background with black text and the tag 76 may have a black background with white text.

In some embodiments, a kit version may include two tags attached along a leading top edge of each tag. When the tags are folded and attached to the top edge portion of the back side of the underwear, and contrasted against the color of the underwear, the maximum contrast is visible on the outside of the underwear.

By utilizing tags with these contrasting colors, a user is quickly able to identify and grasp the tag. By providing an efficient way for the user to identify and grasp the tag, a repeatable protocol may be followed that allows the user to efficiently and effectively orient the underwear. One reason why this is more efficient is because the user only has to grasp the tag. Comparatively, without the wardrobe management system described herein, the user might inefficiently and/or ineffectively grab multiple parts of the underwear while attempting to orient the underwear as part of a task.

Figure 6C:
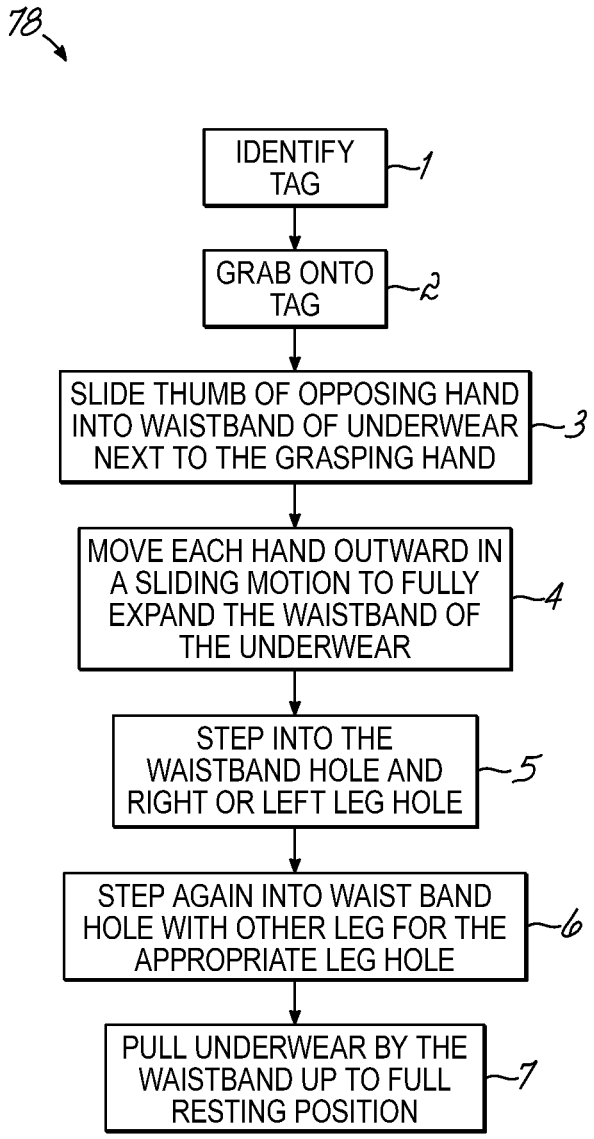
FIG. 6C is a flowchart of a protocol for using a tag to orient the underwear.

FIG. 6C is a flowchart of a protocol 78 for using a tag (e.g., tag 74 and/or tag 76) to orient the underwear. While the protocol is described as being applied to underwear, it is to be understood that this protocol may be applied to one or more other types of garments, such as other lower body garments without fasteners. Furthermore, one or more steps below describe identifying the tag visually and/or grasping the tag with a hand of the user. In situations where the user has a disability, or when a properly lit room is not readily available, one or more steps may be altered to fit the needs of the user and/or situation.

The first step in protocol 78 includes having a user visually identify the tag. The user may be more likely to quickly identify the tag based on the location of the tag being in an optimal location, based on the tag having characteristics that make the tag easily identifiable, and/or the like.

The second step in protocol 78 includes having the user grab onto the tag. For example, the user may grab onto the tag using either hand. The user may be more likely to move or orient the underwear into a desired position based on applying a protocol (described in connection with FIG. 6C) that requires the user to initially grab onto the tag with either hand.

The third step in protocol 78 includes having the user slide the thumb of the opposing hand into the waistband of the underwear next to the grasping hand. The fourth step in protocol 78 includes moving each hand outward in a sliding motion to fully expand the waistband of the underwear.

The fifth step in protocol 78 includes stepping into the waist band hole and right or left leg hole appropriate for the leg used. (right to right, left to left). The sixth step includes stepping again into the waist band hole with the other leg for the appropriate leg hole. (right to right, left to left). The seventh step in protocol 78 includes pulling the underwear by the waistband up to its full resting position.

Figure 7A:
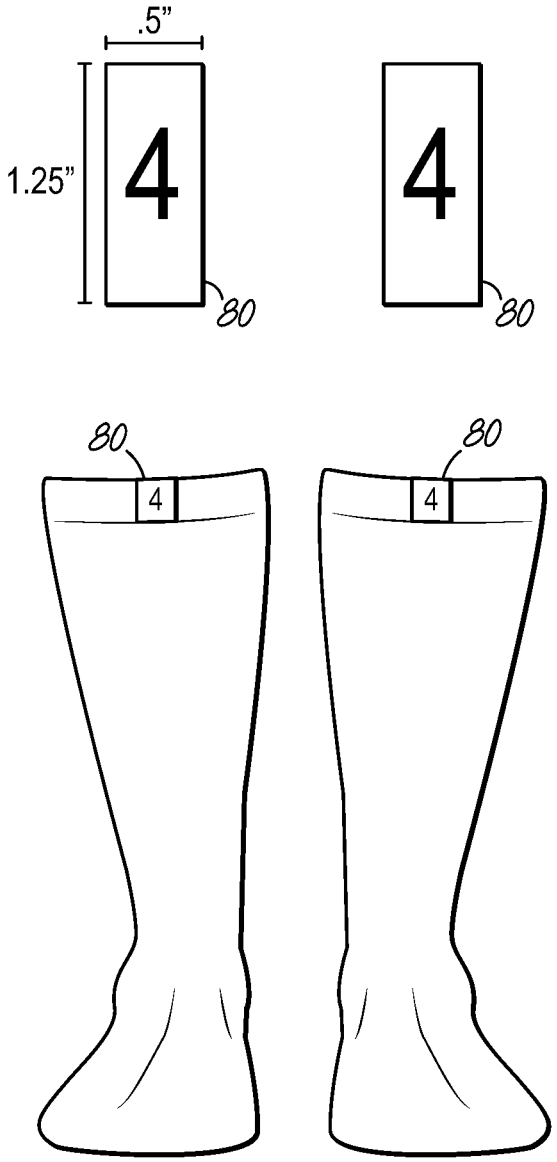
FIG. 7A is a diagram illustrating two example tags and a position of each respective tag on a corresponding sock.

FIG. 7A is a diagram illustrating two example tags 80 and a position of each respective tag 80 on a corresponding sock. As can be seen in FIG. 7A, the tag 80 is a rectangle with large, numerical text placed in a central position on the upper edge portion of the back side of the socks. In the example shown, the dimensions of the tag 80 include a length of 1.25" and a width of 0.5".

In some embodiments, the text may be monochromatic and have a color that contrasts with the background portion of the tag 80. Further, the text is enlarged to fill the entire tag 80. Furthermore, the text is placed in the center of an outwardly facing surface of the tag 80 (e.g., a surface that is visible from the outside of the socks). One or more of these characteristics allow the user to orient the socks for use and to provide visual (or tactile) differentiation from other tags, such as the tags described in connection with FIGS. 5A-5C and FIGS. 6A-6C.

Figure 7B:
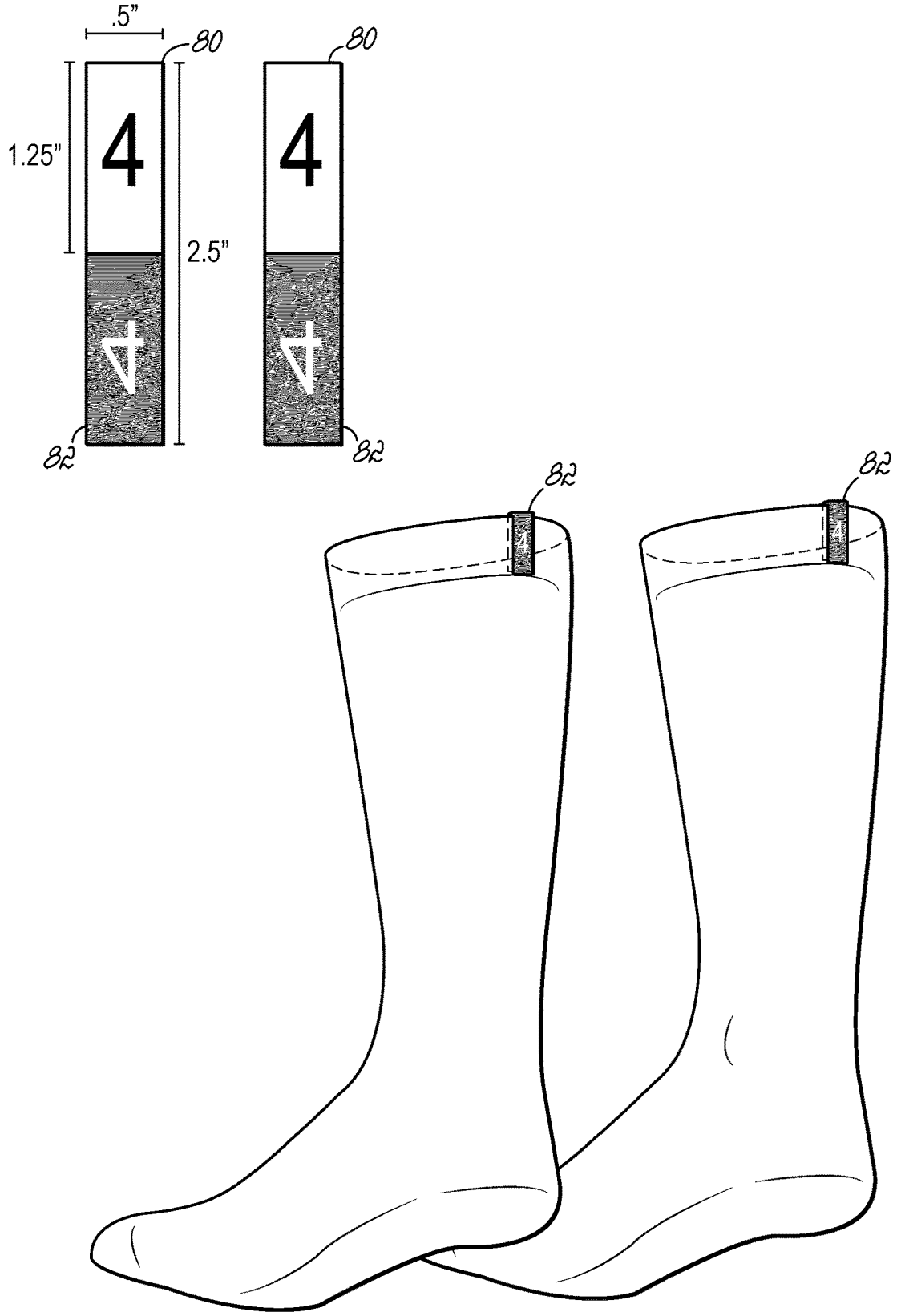
FIG. 7B is a diagram illustrating two connected pairs of tags and the positions of each respective connected pair of tags on the socks.

FIG. 7B is a diagram illustrating two connected pairs of tags and the positions of each respective connected pair of tags on the socks. For example, the two connected pairs of tags may include a first connected pair of tags 80, 82 and a second connected pair of tags 80, 82.

In some embodiments, a kit version may include two tags attached along their opposing 0.5" edges. When folded and attached to the center of the top edge portion of the back side of the socks, and contrasted against the color of the socks, a maximum contrast is visible on the outside of the socks.

Figure 7C:
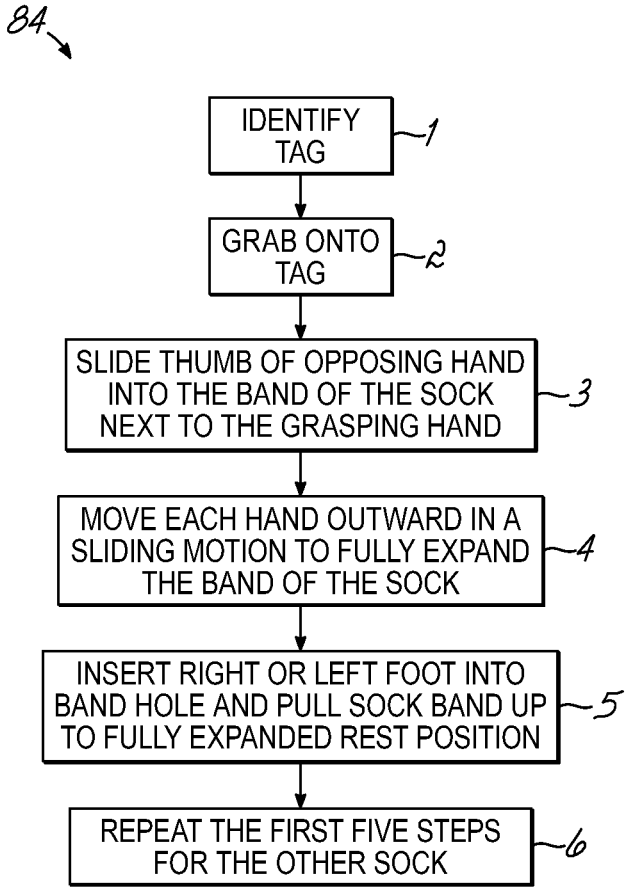
FIG. 7C is a flowchart of a protocol for using a tag to orient the socks.

FIG. 7C is a flowchart of a protocol 84 for using a tag (e.g., tag 80 and/or tag 82) to orient the socks. While the protocol is described as being applied to socks, it is to be understood that this protocol may be applied to one or more other types of garments. Furthermore, one or more steps below describe identifying the tag visually and/or grasping the tag with a hand of the user. In situations where the user has a disability, or when a properly lit room is not readily available, one or more steps may be altered to fit the needs of the user and/or situation.

The first step in protocol 84 includes having a user visually identify the tag. The second step in protocol 84 includes having the user grab onto the tag. For example, the user may grab onto the tag using either hand. The third step in protocol 84 includes sliding the thumb of the opposing hand of the user into the band of the sock next to the grasping hand. The fourth step in protocol 84 includes moving each hand outward in a sliding motion to fully expand the band of the sock.

The fifth step in protocol 84 includes inserting either the right or left foot into the band hole and pulling the sock band up to its fully expanded resting position. The sixth step in protocol 84 includes repeating the first five steps for the other sock/foot.

During development of the three versions identified in FIGS. 5A-5C, 6A-6C, and 7A-7C, it was observed that a wide variety of visual styles, branding, symbols, and tactiles identifying marks on the tag, as well a different geometries and sizes of tags, maybe developed based on the user's needs and the given situation.

In some embodiments, a tag may be positioned on a garment such that a portion of the tag extends beyond an edge of the garment. This may increase the visibility of the tag, thereby further reducing the effort needed by the user to identify the tag. In other embodiments, such as those described elsewhere herein, the tag may be positioned on a garment such that the edge of the tag does not extend beyond the edge of the garment.

In some embodiments, the wardrobe management system described herein may be implemented for applications relating to military use. For example, the wardrobe management system may be used for efficient dressing for people in the military and/or who are in survival situations.

To provide a specific example, a wardrobe management system with military applications may be implemented using nine or more unique tags. One or more of these tags may be further subdivided by special use parameters (hot, cold, dry, wet, and/or the like). By considering special use parameters, the wardrobe management system can assist users with tasks beyond the indexing and orientation described elsewhere herein. The wardrobe management system may provide users with assistance relating to survival, serviceability, logistics, rapid operations/theatre specific uniform of the day (UOD), field distribution functions, pack and use protocols (PUP), and/or the like. The wardrobe management system would have to be differentiated for both land and sea-based PUP infrastructure. One objective would be to better store and deploy a more "hyper-enabled" wardrobe management system across the entirety of the armed services. Additionally, the proposed tag designs include the capacity for much more advanced development. The proposed tags are also able to serve as "tech-enhanced packets," that can accept special use of materials and technology that dovetail with other service-wide "hyper-enabled" projects useful for tracking, coordination, and organization, efficiency, accountability, and other functions.

In some embodiments, the wardrobe management system may utilize a parallel series of "touch-enhanced" tags that are designed for use by the visually disabled/impaired community. These tags serve in the same capacity, but with an emphasis on manually distinguishable and recognizable shapes and textures.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims. Furthermore, even though particular combinations of features are recited in the claims and/or disclosed in the specification, these combinations are not intended to limit the disclosure of various embodiments. In fact, some of the features may be combined in ways not currently recited in the claims or expressly disclosed in the specification.

No element, act, or instruction used herein should be construed as critical or essential unless explicitly described as such. Also, as used herein, the articles "a" and "an" are intended to include one or more items, and may be used interchangeably with "one or more." Further, as used herein, the article "the" is intended to include one or more items referenced in connection with the article "the" and may be used interchangeably with "the one or more." Furthermore, as used herein, the term "set" is intended to include one or more items (e.g., related items, unrelated items, a combination of related and unrelated items, and/or the like), and may be used interchangeably with "one or more." Where only one item is intended, the phrase "only one" or similar language is used. Also, as used herein, the terms "has," "have," "having," or the like are intended to be open-ended terms.

Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). Still further, the phrase "at least one of," followed by a list of items that are joined using the word "and," refers to a list that can include at least one of the listed items. For example, at least one of A, B, and C, refers to a list that can include any of A, B, C, or that includes any combination of A, B, C. This language does not limit the list to requiring any particular item in the list.

What is claimed is:

1. A method for using tags to perform a task relating to wardrobe management for garments of a garment ensemble, the method comprising:

providing the garments of the garment ensemble, the garments including at least a first garment with a first tag and a second garment with a second tag, wherein the first garment is a first type of garment and the second garment is a second type of garment, wherein each respective tag has a designated predetermined location on only an outside portion of the corresponding garment, wherein each tag includes a characteristic indicative of an order in which to perform the task relating to wardrobe management;

selecting the first garment over the second garment based on the first tag including the characteristic indicative of the order in which to perform the task relating to wardrobe management;

identifying an orientation of the first garment based on at least one of:

the first tag being on the outside portion of the first garment, and the characteristic of the first tag;

in response to identifying the orientation of the first garment, making contact with the first tag in a manner that orients the first garment to a position suitable for beginning the task relating to wardrobe management; and while continuing to make contact with the first tag, manipulating the position of the first garment in accordance with instructions included in a predefined protocol to complete the task relating to wardrobe management.

2. The method of claim 1, wherein the designated predetermined location of the first tag is on the outside portion of the first garment and is further defined as being in a central position on a lower back side of the first garment; and wherein identifying the orientation of the first garment comprises:

identifying the orientation of the first garment based on the designated predetermined location of the first tag.

3. The method of claim 1, wherein identifying the orientation of the first garment comprises:

identifying a side of the first garment as a front side, a back side, a top side, or a bottom side, based on at least one of one or more characteristics of the first tag, and identifying the orientation of the first garment based on identifying the side of the first garment.

4. The method of claim 1, wherein the task relating to wardrobe management includes at least one of:

folding the first garment, storing the first garment, and wearing the first garment.

5. The method of claim 1, further comprising:

after identifying the orientation of the first garment, providing the predefined protocol containing instructions identifying a series of physical manipulations for performing the task relating to wardrobe management on the first garment, wherein the predefined protocol for the first garment is different than a predefined protocol for the second garment.

6. The method of claim 1, wherein the first garment is pull-down garment, wherein making contact with the first tag includes making contact using a first hand, and wherein manipulating the position of the first garment in accordance with the instructions included in the predefined protocol comprises:

using a second hand to enter the pull-down garment by making a sweeping motion to move the second hand, and a corresponding arm, to a side of the pull-down garment corresponding to an armhole, moving the second hand to the first tag to grasp the first tag and releasing the first tag with the first hand, using the first hand to enter the pull-down garment by making a sweeping motion to move the first hand, and a corresponding arm, to a side of the pull-down garment corresponding to another armhole, moving a head of a wearer through a hole at a bottom of the pull-down garment until the head and neck of the wearer move through a hole at a top side of the pull-down garment, and pulling down a body of the pull-down garment with one or both of the first hand and the second hand.

7. The method of claim 1, wherein the first garment is pull-up garment, wherein making contact with the first tag includes making contact using a first hand, and wherein manipulating the position of the first garment in accordance with the instructions included in the predefined protocol comprises:

sliding a thumb of a second hand into a band located next to the first hand, moving each hand outward in a sliding motion to fully expand the band of the pull-up garment, placing a first leg into a first leg hole of the pull-up garment, placing a second leg into a second leg hole of the pull-up garment, and pulling up the pull-up garment by the band to a full resting position.

8. The method of claim 1, wherein the first tag is flush with a surface of the first garment and the second tag is flush with a surface of the second garment.

9. The method of claim 1, wherein the designated predetermined location of each respective tag is such that each respective tag extends to, but not past, a hem of the corresponding garment.

10. The method of claim 1, wherein each respective tag is fixedly connected to the corresponding garment such that each respective tag cannot be removed from the corresponding garment.

11. The method of claim 1, wherein manipulating the position of the first garment in accordance with the instructions included in the predefined protocol permits completion of the task relating to wardrobe management in X number of physical manipulations, where X is fewer than Y number of physical manipulations needed to complete the task when starting from a location other than the designated predetermined location or when manipulating the position of the first garment without the instructions included in the predefined protocol.

12. A method of using a set of tags to perform a task relating to wardrobe management for a plurality of garments, the method comprising:

providing the plurality of garments, the plurality of garments including at least a first garment with a first tag and a second garment with a second tag, each respective tag having a designated predetermined location on an outside portion of the corresponding garment, wherein each tag includes a characteristic indicative of an order in which to perform the task relating to wardrobe management;

selecting the first garment based on the first tag including a characteristic indicating that the first garment is to be prioritized over the second garment;

identifying an orientation of the first garment based on at least one of:

the tag being on the outside portion of the garment, and one or more characteristics of the tag;

in response to identifying the orientation of the first garment, making contact with the first tag to orient the first garment to a position suitable for beginning the task relating to wardrobe management; and while maintaining contact with the first tag, manipulating the position of the first garment in accordance with instructions included in a predefined protocol to complete the task relating to wardrobe management, wherein the predefined protocol for completing the task for the first garment is different than another predefined protocol for completing the same task for the second garment.

13. The method of claim 12, wherein selecting the first garment, from the plurality of garments, is based on the designated location of the first tag of the first garment being different than the designated predetermined location of the second tag of the second garment.

14. The method of claim 12, wherein the designated predetermined location of the first tag is on the outside portion of the first garment and is further defined as being in a central position on a back side of the first garment; and wherein identifying the orientation of the first garment comprises:

identifying the orientation of the first garment based on the predetermined designated location of the first tag.

15. The method of claim 12, wherein identifying the orientation of the first garment comprises:

identifying the orientation of the first tag based on one or more directional indicators associated with at least one of one or more characteristics of the tag, and identifying the orientation of the first garment based on the orientation of the first tag.

16. The method of claim 12, wherein identifying the orientation of the first garment comprises:

identifying a side of the first garment as a front side, a back side, a top side, or a bottom side, based on at least one of the one or more characteristics of the tag, and identifying the orientation of the first garment based on identifying the side of the first garment.

17. The method of claim 12, wherein the first garment is a sock, wherein making contact with the first tag includes making contact using a first hand, and wherein manipulating the position of the sock in accordance with the instructions included in the predefined protocol comprises:

sliding a thumb of a second hand into a band of the sock, moving each hand outward in a sliding motion to fully expand the band of the sock, and inserting a foot into a band hole and pulling the band upward to a fully expanded rest position.

18. The method of claim 12, wherein the plurality of garments further includes a third garment, and wherein the method further comprises:

selecting the second garment based on the second tag including a characteristic indicating that the task relating to wardrobe management is to be performed before the task relating to wardrobe management is to be performed for the third garment;

identifying an orientation of the second garment based on at least one of:

the second tag being on the outside portion of the garment, and the characteristic of the second tag;

in response to identifying the orientation of the second garment, making contact with the second tag to orient the second garment to a position suitable for beginning the task relating to wardrobe management; and while maintaining contact with the second tag, manipulating the position of the first garment in accordance with instructions included in the other predefined protocol to complete the task relating to wardrobe management, wherein the other protocol for completing the task for the second garment is different than yet another predefined protocol for completing the same task for the third garment.

* * * * *